US008821073B2

(12) United States Patent
Patton

(10) Patent No.: US 8,821,073 B2
(45) **Date of Patent: *Sep. 2, 2014**

(54) CONCENTRICALLY LOADED, ADJUSTABLE PIERING SYSTEM

(71) Applicant: Steve Patton, Rogers, AR (US)

(72) Inventor: Steve Patton, Rogers, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/056,227

(22) Filed: Oct. 17, 2013

(65) Prior Publication Data

US 2014/0041334 A1 Feb. 13, 2014

Related U.S. Application Data

(63) Continuation of application No. 13/526,329, filed on Jun. 18, 2012, and a continuation-in-part of application No. 12/632,572, filed on Dec. 7, 2009, now Pat. No. 8,206,063.

(60) Provisional application No. 61/141,328, filed on Dec. 30, 2008.

(51) Int. Cl.

| | |
|---|---|
| ***E02D 7/00*** | (2006.01) |
| ***E02D 11/00*** | (2006.01) |
| ***E02D 13/00*** | (2006.01) |
| ***E02D 27/48*** | (2006.01) |
| ***B66F 3/24*** | (2006.01) |
| ***E02D 5/00*** | (2006.01) |
| ***E02B 3/06*** | (2006.01) |
| ***E01D 15/14*** | (2006.01) |

(52) U.S. Cl.
CPC . *E02D 27/48* (2013.01); *B66F 3/24* (2013.01); *E02D 5/00* (2013.01); *E02B 3/068* (2013.01); *E01D 15/14* (2013.01)
USPC ..... 405/232; 52/741.15

(58) Field of Classification Search
USPC ..... 52/741.15; 405/232
See application file for complete search history.

(56) References Cited

U.S. PATENT DOCUMENTS

| | | | | |
|---|---|---|---|---|
| 996,397 | A | 6/1911 | Breauchaud | |
| 1,181,212 | A | 5/1916 | Clark | |
| 2,801,522 | A | 8/1957 | Kuhn | |
| 3,222,030 | A | 12/1965 | Thorpe | |
| 5,096,333 | A | 3/1992 | Bassett | |
| 5,131,790 | A | 7/1992 | Simpson | |
| 5,228,807 | A | 7/1993 | Willcox, Jr. | |
| 5,320,453 | A | 6/1994 | Bullivant | |
| 5,399,055 | A | 3/1995 | Dutton, Jr. | |
| 5,505,030 | A | 4/1996 | Haraldsson | |
| 5,516,237 | A * | 5/1996 | Hebant | 405/233 |
| 5,595,366 | A | 1/1997 | Cusimano | |
| 5,713,701 | A | 2/1998 | Marshall | |
| 5,819,482 | A | 10/1998 | Belke et al. | |
| 7,090,435 | B2 | 8/2006 | Mitchell | |
| 8,206,063 | B2 | 6/2012 | Patton | |

(Continued)

*Primary Examiner* — Chi Q Nguyen
(74) *Attorney, Agent, or Firm* — Erickson Kernell Derusseau & Kleypas, LLC

(57) ABSTRACT

A method for constructing a pier system to stabilize and level a structure by constructing a pier in sections and advancing the pier sections below a foundation using a hydraulic ram until bedrock is reached, and completing the piering system by positioning a head plate on top of the pier to provide a stable platform for a house jack and applying a vertical lifting force with the house jack to lift the foundation of the structure.

20 Claims, 3 Drawing Sheets

(56) References Cited

U.S. PATENT DOCUMENTS

2002/0062622 A1 5/2002 Bell
2002/0095880 A1 7/2002 MacKarvich
2003/0033760 A1 2/2003 Lorman
2008/0304919 A1 12/2008 Coyle

* cited by examiner

CONCENTRICALLY LOADED, ADJUSTABLE PIERING SYSTEM

CROSS REFERENCE TO RELATED APPLICATIONS

This application is a continuation of application Ser. No. 13/526,329, filed Jun. 18, 2012, which is a continuation-in-part of application Ser. No. 12/632,572, filed Dec. 7, 2009 (now U.S. Pat. No. 8,206,063), which claims priority of application Ser. No. 61/141,328, filed Dec. 30, 2008, all of which are incorporated herein by reference.

BACKGROUND

The present invention relates to piering systems and in particular to a concentrically loaded, adjustable, steel pipe foundation repair piering system.

In many areas of the United States building foundations rest on unstable soil. Changes in local condition cause soil movement and damage to the building. Piering systems are used in such areas to provide support from bedrock under the buildings. Known piering systems include piers sunk below the foundation to a stable surface, for example, bedrock. The pier system reaches up to the foundation to provide vertical support. Unfortunately, the bottom of the foundation may not provide a horizontal surface for the support to push against and movement of the foundation may result in the foundation breaking away from the support.

Further, concentrically loaded piering systems (those installed directly under the wall being supported or lifted, as opposed to being attached to the outer edge of the foundation footing) typically are easy to break with offset loads created by imperfect installation, and have loose adjusting components ("shims") that can fall off if the structure moves after installation. Piers installed directly under the wall must be installed in very short "segments". The link between the segments must be very strong to prevent breakage.

Known piering systems typically require a number of loose adjusting components (or shims) which may fall off if the structure "heaves" or moves after installation. As a result, the piering system may require adjusting after a minor soil movement due to the lost shims even if the foundation returns to the original position.

A need thus remains for an improved piering system which remains attached to the building foundation and can tolerate sloped foundation bottom surfaces.

SUMMARY

The present invention addresses the above and other needs by providing a piering system which includes a heave plate attached to a foundation and supported by a pier. A downward facing socket is permanently attached to the heave plate. The socket receives the top end of a heavy stud of a coupling assembly, the bottom end of the stud is screwed into a captive nut of a shim-block. A nut is welded to the stud leaving about ½ inch of the stud protruding upwards for insertion into the socket. The nut may be turned to adjust the height of the stud. The shim-block and coupling assembly are supported by a headplate and the headplate is supported by the pier. The headplate includes a wide table for supporting a pair of jacks on opposite sides of the shim-block allowing adjustment of the foundation. The cooperation of the ball and socket help to prevent "off-set loads" which otherwise may break the piering system.

In accordance with one aspect of the invention, there is provided a piering system that makes a concentrically loaded pier stronger and provides an adjustable feature without loose components that could fall off if the structure "heaves" or moves after installation. The piering system may be used to support or lift a broken foundation requiring repair.

In accordance with another aspect of the invention there is provided a piering system with increased "side-load" strength, thereby eliminating breakage by creating a "solid" inner pipe link between segments. The assembly that contacts the bottom of the foundation typically has many loose adjusting components ("shims") that can fall off if the foundation "heaves" or moves after installation. The present invention provides for a wide range of adjustability without any loose components that may come loose or fall off. If the structure "heaves" up off the pier, it will return to its properly supported position after the structure returns to its pre-heaving position.

In accordance with yet another aspect of the invention there is provided a method for constructing a pier system. The method includes constructing a pier performing the steps of: forming a hole reaching about 26 inches below the foundation; placing a pier base having a base cylinder portion in the bottom of the hole; placing a first outer cylinder over the base cylinder portion; inserting a first inner cylinder inside a recess in the first outer cylinder butting against the base cylinder portion; and repeating the steps of adding an additional overlapping outer cylinder and an additional inner cylinder providing a 50 percent overlap of consecutive cylinders, creating a link between the outer cylinders, and advancing the cylinders downward using a hydraulic ram until bedrock is reached.

After bedrock is reached, completing the piering system with the steps of: cutting the top cylinders to be approximately ten inches below the foundation; positioning a head plate on top of the pier to provide a stable platform for a house jack; placing a heave plate between the house jack and the bottom of the foundation to distribute force applied by the house jack to the foundation; adjusting the foundation to stabilize and/or level the foundation of the structure; after adjusting is achieved, positioning additional jacks on the head plate on either side of the house jack to support the heave plate; removing the house jack; positioning a shim block and coupling assembly with the coupling assembly screwed down into the shim block; advancing the coupling assembly upward until the coupling assembly reaches into a socket of the heave plate, removing the additional jacks; drilling holes through holes in the heave plate and into the foundation; and driving concrete anchors through holes in the heave plate and into the holes drilled into the foundation to fix the heave plate to the foundation. The shim block may be attached to the head plate by bending straps over to lock the shim block to the head plate or by bolting the shim block to the head plate. The head plate and shim block thus work together to create a fully adjustable leveling mechanism that is locked together with no loose components that can fall or shift if the structure moves after installation.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
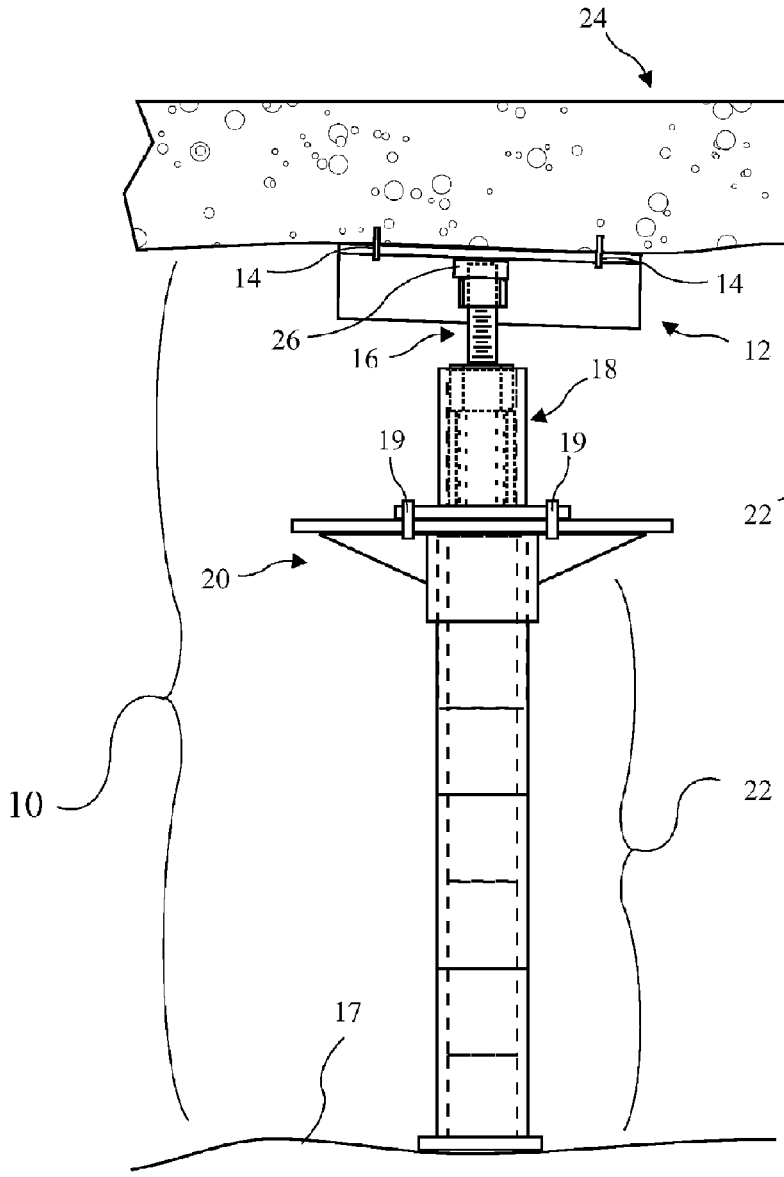
FIG. 1 shows a piering system according to the present invention supporting a foundation.

A piering system 10 according to the present invention is shown supporting a foundation 24 in FIG. 1. The piering system 10 includes a heave plate 12, a coupling assembly 16, a shim-block 18, a head plate 20 and a pier 22. The heave plate 12 is attached to the foundation 24 by attachments 14 which may be stakes, bolts, studs, or the like and fix the heave plate 12 to the foundation 24, and are preferably concrete anchors driven into the foundation 24 through pre-drilled holes 13 in the heave plate 12, permanently attaching the heave plate to the foundation. As a result, unlike known piering systems, the heave plate 12 of the piering system 10 according to the present invention moves with the foundation 24. The coupling assembly 16 reaches into a socket 26 welded or otherwise fixedly attached to the heave plate 12, and the coupling assembly 16 remains in engagement with the heave plate 12 during typical movement of the foundation 24. The height of the coupling assembly 16 is adjustable and eliminates the need for shims in known piering systems, which shims are often displaced and lost when the foundation 24 moves. The piering system 10 allowed simple readjustment to compensate for foundation movement.

Figure 2:
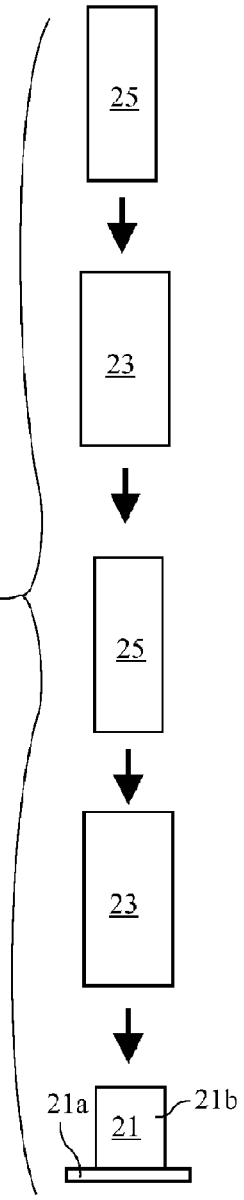
FIG. 2 shows an exploded view of a pier of the piering system.

An exploded view of a pier of the piering system 22 is shown in FIG. 2. The piering system includes a base 21 having a flange 21*a* which preferably rests on a stable base 17, for example, bed rock, outer cylinders 23 and inner cylinders 25. The cylinders overlap providing a double wall thickness for the pier 22. The bottom most outer cylinder 23 overlaps the cylinder portion 21*b* of the base 21, the bottom most inner cylinder 25 fits into the top half of the bottom most outer cylinder 23 and butts against the cylinder portion 21*b*, and such construction is repeated to form the complete pier 22. The flange 21*a* is preferably an approximately three inch diameter disk, the cylinder portion 21*b* is an approximately six inch long segment of approximately 2⅜ inch Outside Diameter (OD) pipe, the outer cylinders 23 are preferably approximately twelve inch long segment of approximately 2⅞ inch OD pipe, and the inner cylinders 225 are preferably approximately twelve inch long segment of approximately 2⅜ inch OD pipe. The cylinders are preferably made of approximately 0.220 thickness or schedule 40 steel tubing and more preferably made of schedule 40 high carbon steel tubing.

Figure 3C:
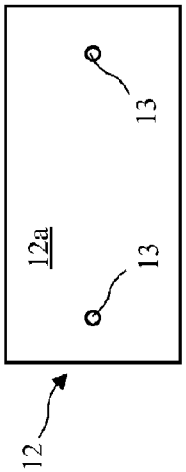
FIG. 3C is a top view of the heave plate according to the present invention.
Figure 3A:
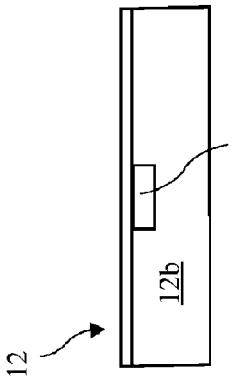
FIG. 3A is a front view of a heave plate according to the present invention.
Figure 3D:
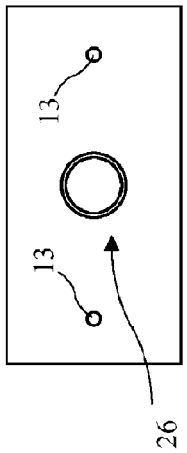
FIG. 3D is a bottom view of the heave plate according to the present invention.
Figure 3B:
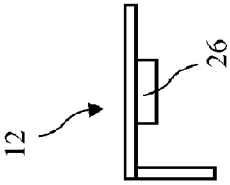
FIG. 3B is a side view of the heave plate according to the present invention.

A front view of the heave plate 12 according to the present invention is shown in FIG. 3A, a side view of the heave plate 12 is shown in FIG. 3B, a top view of the heave plate 12 is shown in FIG. 3C, and a bottom view of the heave plate 12 is shown in FIG. 3D. The heave plate 12 includes a table 12*a* for residing against the foundation 24 and a substantially vertical ledge (or angle) 12*b* attached along the length of one edge of the table 12*a* to strengthen the heave plate 12. The heave plate 12 may alternatively be cut from angle material. A socket 26 is welded or similarly attached to a bottom surface of the table 12*a* and provides an open mouth for capturing the coupling assembly 16. The table 12*a* is preferably approximately six inches by fourteen inches and the ledge 12*b* is preferably approximately four inches high. The heave plate 12 may, for example, be cut from four by six inch, ⅜ inch thick steel angle, cut in 14 inch lengths. The socket 26 is preferably a 2⅞ by ¾ inch pipe nipple, but may be a short section of pipe or the like welded to the bottom surface of the table 12*a*.

Figure 5B:
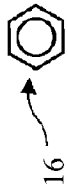
FIG. 5B is a top view of the coupling assembly according to the present invention.
Figure 5A:
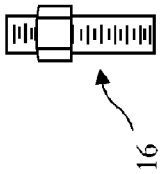
FIG. 5A is a side view of the coupling assembly according to the present invention.
Figure 4:
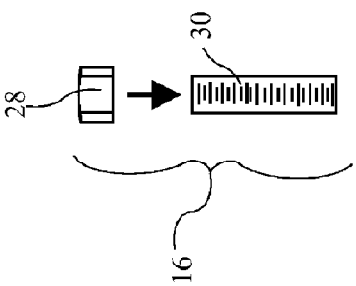
FIG. 4 is a prior to assembly side view of a coupling assembly according to the present invention.

A prior to assembly side view of the coupling assembly 16 according to the present invention is shown in FIG. 4, a side view of the assembled coupling assembly 16 is shown in FIG. 5A, and a top view of the assembled coupling assembly 16 is shown in FIG. 5B. The coupling assembly 16 is preferably constructed from an approximately seven inch length of approximately 1¼ inch diameter to approximately 1½ inch diameter grade-8 threaded material stud 30 and the nut 28 is a matching thread nut preferably welded to the stud 30, but the nut 28 may be attached using, for example, permanent Loctite® threadlock or similar material. Alternatively, other fittings may be attached to the stud to allow turning the stud for adjustment and a coupling assembly including any means for turning is intended to come within the scope of the present invention.

Figure 7B:
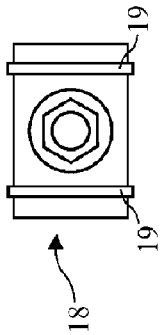
FIG. 7B is a top view of the shim block according to the present invention.
Figure 7A:
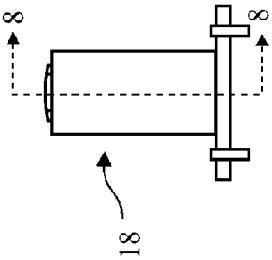
FIG. 7A is a side view of the shim block according to the present invention.
Figure 6:
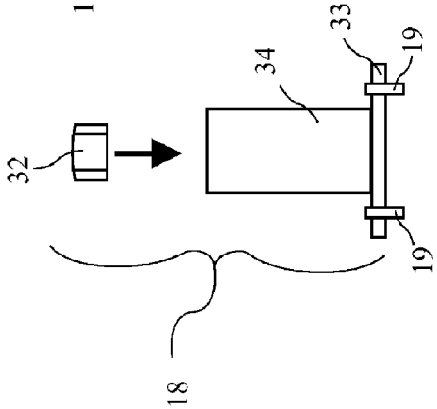
FIG. 6 is a prior to assembly side view of a shim block according to the present invention.
Figure 8:
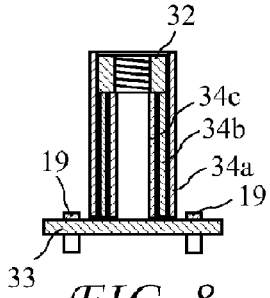
FIG. 8 is a cross-sectional view of the shim block taken along line 8-8 of FIG. 6.

A prior to assembly side view of the shim block 18 according to the present invention is shown in FIG. 6, a side view of the assembled shim block 18 is shown in FIG. 7A, a top view of the assembled shim block 18 is shown in FIG. 7B, and a cross-sectional view of the shim block 18 taken along line 8-8 of FIG. 7 is shown in FIG. 8. The shim block 18 includes a base 33, a shaft 34, and a nut 32. The base 33, column 34, and nut are preferably welded together. The nut 32 has the same thread as the stud 30 allowing the coupling assembly 16 to be advanced and retreated vertically by turning the stud 30.

The column 34 is preferably constructed of an approximately 2¹⁄₁₆ inch pipe 34 *c* inside an approximately 2⅜ inch pipe 34 *b* inside an approximately 2⅞ inch pipe 34 *a*, and the pipes 34 *b* and 34 *c* are preferably recessed approximately ½ inches into the pipe 34 *a* providing a recess and vertical support for the nut 32. The base 33 preferably measures approximately 4 inches by approximately 4 inches, and is preferably approximately ½ inch thick steel plate.

Straps 19 (also see FIGS. 9A 10*a* and 10B) are provided to attach the shim block 18 to the head plate 20. The straps 19 are preferably welded to the base 33 on both sides of the shim block 18. The straps 19 allow the shim block 18 to be locked to the head plate 20 using only a hammer In an alternative embodiment, the straps 19 are replace by two bolts in opposite front corners attaching the shim block 18 to the head plate 20.

Figure 9C:
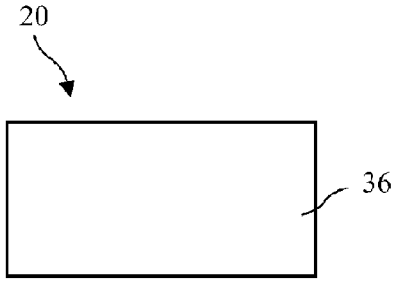
FIG. 9C is a top view of the head plate according to the present invention.
Figure 9A:
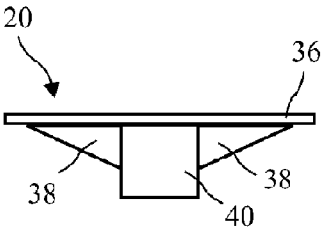
FIG. 9A is a front view of a head plate according to the present invention.
Figure 9B:
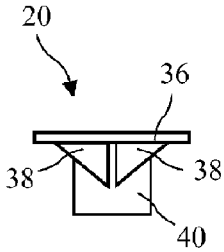
FIG. 9B is a side view of the head plate according to the present invention.
Figure 9D:
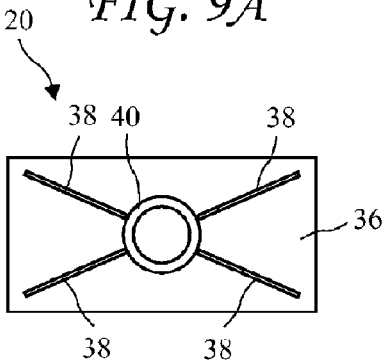
FIG. 9D is a bottom view of the head plate according to the present invention.

A front view of the head plate 20 according to the present invention is shown in FIG. 9A, a side view of the head plate 20 is shown in FIG. 9B, a top view of the head plate 20 is shown in FIG. 9C, and a bottom view of the head plate 20 is shown in FIG. 9D. The head plate 20 includes a head plate table 36, head plate cylinder 40, and gussets 38. The table 36 supports the shim block 18 and is preferably made from approximately six inches by approximately fourteen inches of ½ inch thick steel plate. The cylinder 40 is welded to the bottom of the table 36 and is sized to fit over the top of the pier 22 and is approximately six inches high. The gussets 38 brace the table 36 to the cylinder 40.

Figure 10A:
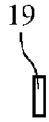
FIG. 10A is a front view of a strap according to the present invention.
Figure 10B:
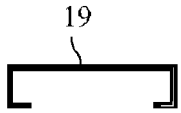
FIG. 10B is an edge view of the strap according to the present invention.

A front view of the strap 19 according to the present invention is shown in FIG. 10A and an edge view of the strap 19 is shown in FIG. 10B. The straps 19 are preferably approximately eight inches long and are made from approximately ½ inch by approximately ¼ inch steel strap.

A method for constructing a pier system according to the present invention includes the following steps. A hole is formed about 26 inches below the foundation 24. The base 21 including a cylinder portion 21 *b* is placed in the bottom of the hole. A first outer cylinder 23 is placed over the cylinder portion 21 *b* creating a six inch recess inside the outer cylinder 23. A first inner cylinder 25 is placed inside the recess in the first outer cylinder 23 butting against the cylinder portion 21 *b*. The steps of adding an additional overlapping outer cylinder 23 and an additional inner cylinder 25 are repeated providing a 50 percent overlap of consecutive cylinders 23 and 25 creating a link between the outer cylinders 23 which cannot be broken because the inner cylinders 23 extend six inches on both sides of the joint between the outer cylinder 23. The cylinders 23 and 25 are added and the forming pier 22 is advanced downward using a hydraulic ram until a stable base, preferably bedrock, is reached.

After the stable base is reached, the top most cylinders 23 and 25 are cut to be approximately ten inches below the foundation 24. The head plate 20 is positioned on top of the pier 22 to provide a stable platform for a house jack (preferably a ten-ton house jack) which is used in conjunction with other piers 22 and house jacks to adjust (i.e., stabilize and/or level) the foundation 24 of the structure. A heave plate 12 is sandwiched between the house jack and the foundation 24 to distribute the lifting force of the house jack to avoid damaging the foundation 24. After stabilization is achieved, additional jacks are placed on the head plate 20 either side of the house jack to support the heave plate 12 and the house jack is removed. The house jack is replaced by the shim block 18 with the coupling assembly 16 screwed down into the shim block 18. The shim block 18 which is adjusted by turning the coupling assembly 16 until the coupling assembly 16 reaches into the socket 26 of the heave plate 12. The additional jacks may then be removed. Holes are drilled through the holes 13 in the heave plate 12 and into the bottom of the foundation 24 and concrete anchors 14 are driven through the holes 13 in the heave plate 12 and into the holes to fixedly attach the heave plate 12 to the foundation 24. The straps 19 are then bent over to lock the shim block 18 to the head plate 20 or bolts are installed attaching the shim block 18 to the head plate 20. The head plate 20, shim block 18, and heave plate 16 thus work together to create a fully adjustable leveling mechanism that is locked together with no loose components that can fall or shift if the structure moves after installation.

While the invention herein disclosed has been described by means of specific embodiments and applications thereof, numerous modifications and variations could be made thereto by those skilled in the art without departing from the scope of the invention set forth in the claims.

It is to be understood that while certain now preferred forms of this invention have been illustrated and described, it is not limited thereto except insofar as such limitations are included in the following claims.

Having thus described the invention, what is claimed as new and desired to be secured by Letters Patent is as follows:

1. A method for constructing a pier system to stabilize and level a structure, the method comprising:

constructing a pier comprising the steps of:

forming a hole below a foundation of the structure;

placing a pier base in the bottom of the hole;

placing a first outer pier section over the pier base;

inserting a first inner pier section inside a recess in the first outer pier section, the first inner pier section butting against the pier base; and repeating the steps of adding an additional overlapping outer pier section and an additional inner pier section providing an overlap of consecutive pier sections creating a link between the outer pier sections and advancing the pier sections downward using a hydraulic ram until bedrock is reached;

completing the piering system comprising the steps of:

positioning an at least one house jack on top of the pier; and using the at least one house jack to apply a vertical lifting force to lift the foundation of the structure to adjust the structure.

2. The method of claim 1 wherein said hole in said forming step is about 26 inches deep.

3. The method of claim 1 wherein said completing step includes positioning a head plate on top of the pier and then positioning the at least one house jack on top of the head plate.

4. The method of claim 1 further comprising positioning a heave plate between the at least one house jack and the foundation.

5. The method of claim 4 further comprising positioning a shim block and coupling assembly on the head plate and advancing the coupling assembly upward until the coupling assembly contacts the heave plate.

6. The method of claim 5 further comprising removing the at least one house jack.

7. The method of claim 4 further comprising anchoring the heave plate to the foundation.

8. The method of claim 7 further comprising removing the at least one house jack.

9. The method of claim 4 further comprising anchoring the heave plate to the foundation.

10. The method of claim 1 further comprising positioning a shim block and coupling assembly on the head plate and advancing the coupling assembly upward until the coupling assembly contacts the foundation.

11. A method for constructing a pier system to stabilize and level a structure, the method comprising:

constructing a pier comprising the steps of:

forming a hole below a foundation of the structure;
placing a pier base in the bottom of the hole;
placing a first outer pier section over the pier base;
inserting a first inner pier section inside a recess in the first outer pier section, the first inner pier section butting against the pier base; and
repeating the steps of adding an additional overlapping outer pier section and an additional inner pier section providing an overlap of consecutive pier sections creating a link between the outer pier sections and advancing the pier sections downward using a hydraulic ram until bedrock is reached;
completing the piering system comprising the steps of:
positioning a head plate on top of the pier to provide a stable platform for an at least one house jack;
positioning the at least one house jack on the head plate;
using the at least one house jack to apply a vertical lifting force to lift the foundation of the structure to adjust the structure;
positioning a coupling assembly on the head plate;
expanding the coupling assembly until the coupling assembly contacts the structure; and
removing the at least one house jack.

12. The method of claim 11 wherein said hole in said forming step is about 26 inches deep.

13. The method of claim 11 further comprising positioning a heave plate between the at least one house jack and the foundation.

14. The method of claim 13 further comprising positioning a shim block and coupling assembly on the head plate and advancing the coupling assembly upward until the coupling assembly contacts the heave plate.

15. The method of claim 14 further comprising removing the at least one house jack.

16. The method of claim 13 further comprising anchoring the heave plate to the foundation.

17. The method of claim 11 further comprising positioning a shim block and coupling assembly on the head plate and advancing the coupling assembly upward until the coupling assembly contacts the foundation.

18. A method for constructing a pier system to stabilize and level a structure, the method comprising:
constructing a pier comprising the steps of:
forming a hole below a foundation of the structure;
placing a pier base in the bottom of the hole;
placing a first outer pier section over the pier base;
inserting a first inner pier section inside a recess in the first outer pier section, the first inner pier section butting against the pier base; and
repeating the steps of adding an additional overlapping outer pier section and an additional inner pier section providing an overlap of consecutive pier sections creating a link between the outer pier sections and advancing the pier sections downward using a hydraulic ram until bedrock is reached;
completing the piering system comprising the steps of:
positioning a head plate on top of the pier to provide a stable platform for an at least one house jack;
positioning the at least one house jack on the head plate;
positioning a heave plate between the at least one house jack and the foundation;
using the at least one house jack to apply a vertical lifting force to lift the foundation of the structure to adjust the structure, the heave plate distributing the lifting force to avoid damage to the foundation;
positioning a coupling assembly on the head plate;
expanding the coupling assembly until the coupling assembly contacts the heave plate; and
removing the at least one house jack.

19. The method of claim 18 wherein said hole in said forming step is about 26 inches deep.

20. The method of claim 18 further comprising positioning a shim block with said coupling assembly on the head plate and advancing the coupling assembly upward until the coupling assembly contacts the heave plate.

* * * * *